United States Patent [19]

Ironfield

[11] 4,107,501

[45] Aug. 15, 1978

[54] MICROWAVE OVEN CONTROL SYSTEM

[75] Inventor: Richard Ironfield, Williamsburg, Iowa

[73] Assignee: Raytheon Company, Lexington, Mass.

[21] Appl. No.: 676,460

[22] Filed: Apr. 13, 1976

[51] Int. Cl.[2] ..... H05B 5/00

[52] U.S. Cl. ..... 219/10.55 B; 219/10.55 F

[58] Field of Search ..... 2.9/10.55 B, 10.55 C, 2.9/10.55 D; 333/1.1, 24.2

[56] References Cited

U.S. PATENT DOCUMENTS

| | | | |
|---|---|---|---|
| 3,412,227 | 11/1968 | Anderson | 219/10.55 B |
| 3,662,140 | 5/1972 | Jones et al. | 219/10.55 B |
| 3,716,687 | 2/1973 | Constable | 219/10.55 C |
| 3,829,649 | 8/1974 | Igarashi | 219/10.55 B |
| 3,875,361 | 4/1975 | Fukui | 219/10.55 B |

*Primary Examiner*—J. V. Truhe
*Assistant Examiner*—Bernard Roskoski
*Attorney, Agent, or Firm*—M. D. Bartlett; J. D. Pannone

[57] ABSTRACT

A microwave oven system in which a magnetron supplies microwave energy to a microwave oven through an isolator structure comprising a three-port circulator having a microwave energy absorbing load coupled to the third port, with the temperature of said load being sensed by a first switch actuated at a first temperature level to maintain a flow of air across the load continuously between operating cycles of the oven and by a second thermally operated switch actuated at a higher temperature to disable the power supply for the magnetron.

5 Claims, 6 Drawing Figures

MICROWAVE OVEN CONTROL SYSTEM

BACKGROUND OF THE INVENTION

In U.S. Pat. No. 3,662,140 issued May 9, 1972 to William C. Jones and Dan R. McConnell, there is disclosed a system for protecting a magnetron in a microwave oven with an isolator which uses a three-port circulator. However, it has been discovered that in commercial food merchandising a large number of food products produce large amounts of reflected energy toward the isolator from the oven and, hence, the oven is frequently de-energized due to overheating of the isolator and during the cool-down period of the isolator, the oven is not operable. Such cooling time, which may be fifteen minutes to a half hour during the rush hour of a food merchandising establishment, is costly and can lead to loss of business.

SUMMARY OF THE INVENTION

In accordance with this invention, a control system is provided in which a blower means supplies cooling fluid past microwave energy absorbing means in an isolating structure coupled to a microwave generator and a microwave oven, with said air passing through said oven.

Further in accordance with this invention, there is provided a dual air flow path so that air, which flows through a magnetron microwave generator cooling structure, does not flow past the isolator load.

This invention further discloses that since only the air flowing past the isolator load and the air flowing through the waveguide flows through the microwave heating cavity, the volume of air through the heating cavity and the drying effect on the food bodies being heating therein is reduced while providing sufficient heat and air flow to substantially prevent condensation of grease on the microwave oven walls or waveguide feed containing the isolator.

This invention further provides for a control circuit actuated by thermal sensing means of the isolator for maintaining the flow of air through the isolator during periods when the microwave generator is de-energized and the isolator temperature has reached a predetermined value. More specifically, the invention provides for a normally open thermally actuated switch thermally contacting the microwave energy absorbing load of the third port of a three-port circulator positioned in a waveguide connecting the microwave generator output to the microwave heating cavity, the contacts of said thermally actuated switch being in series with a source of power and a blower supplying a flow of air in heat exchange relationship with said energy absorbing load. When the temperature of the load reaches a predetermined value of, for example, 200° F to 220° F, the switch contacts close to maintain the blower continuously energized until the temperature of the load is reduced to a temperature in the range of 100° F to 200° F.

Further in accordance with this invention, a normally closed thermally actuated switch is positioned in heat exchange relationship with the load of the isolator and electrically in series with a control circuit supplying power to a power supply for the magnetron microwave generator. Said second switch opens at a temperature above the actuation temperature of the first switch and below the Curie temperature of the isolator ferrite, such as 220° F to 300° F, and de-energizes the power supply while the blower circuit remains energized by the actuation of the first thermal sensor switch. Such a circuit permits the isolator load to cool at a sufficiently rapid rate that the oven may be re-energized within a few minutes following opening of the second switch controlling the power supply.

BRIEF DESCRIPTION OF THE DRAWINGS

Other and further objects and advantages of the invention will become apparent as the description thereof progresses, reference being had to the accompanying drawings wherein.

DESCRIPTION OF THE PREFERRED EMBODIMENT

Figure 1:
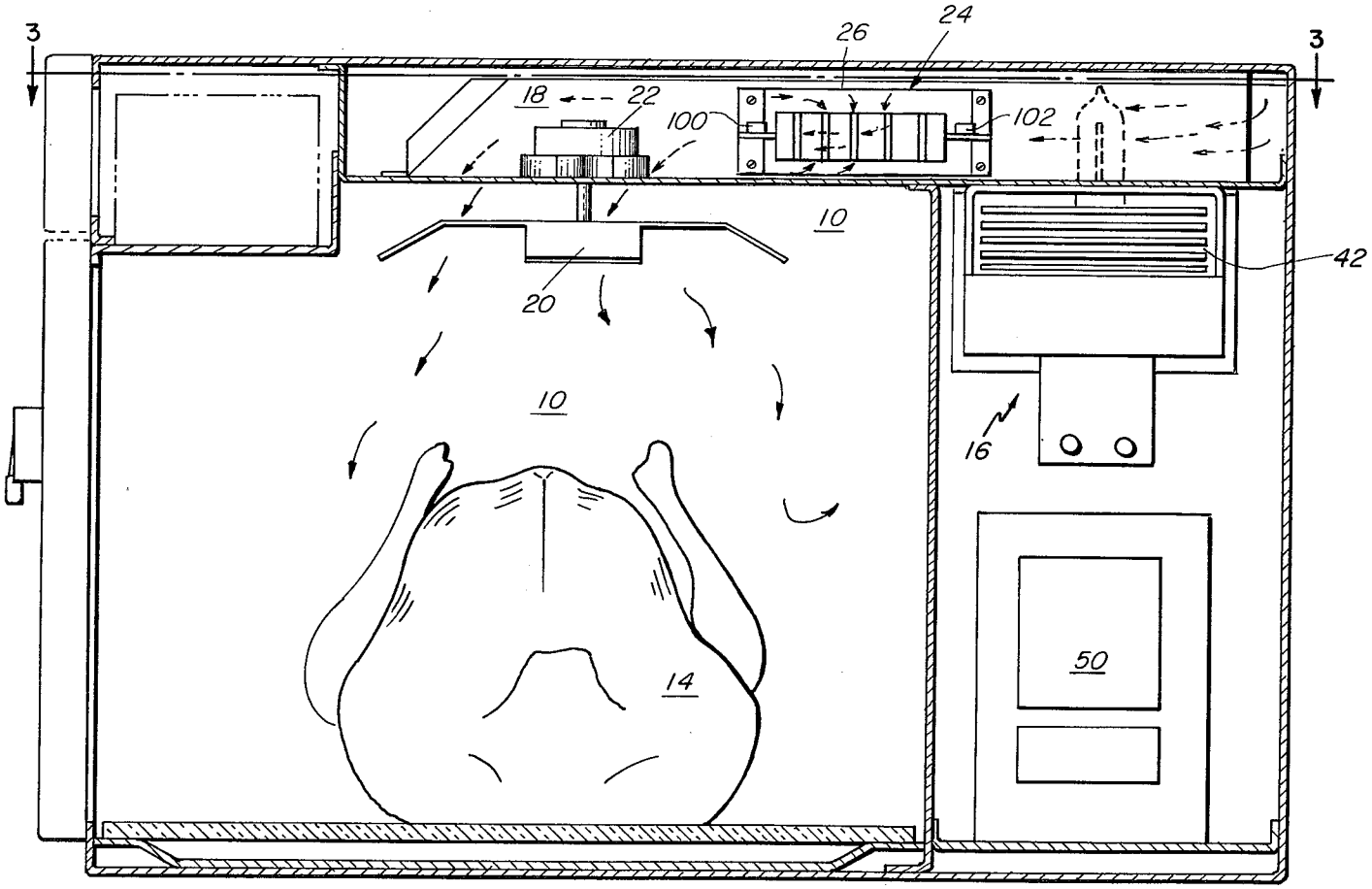
FIG. 1 illustrates a vertical sectional view taken along line 1—1 of FIG. 3 of the oven illustrating the invention with the door closed.
Figure 2:
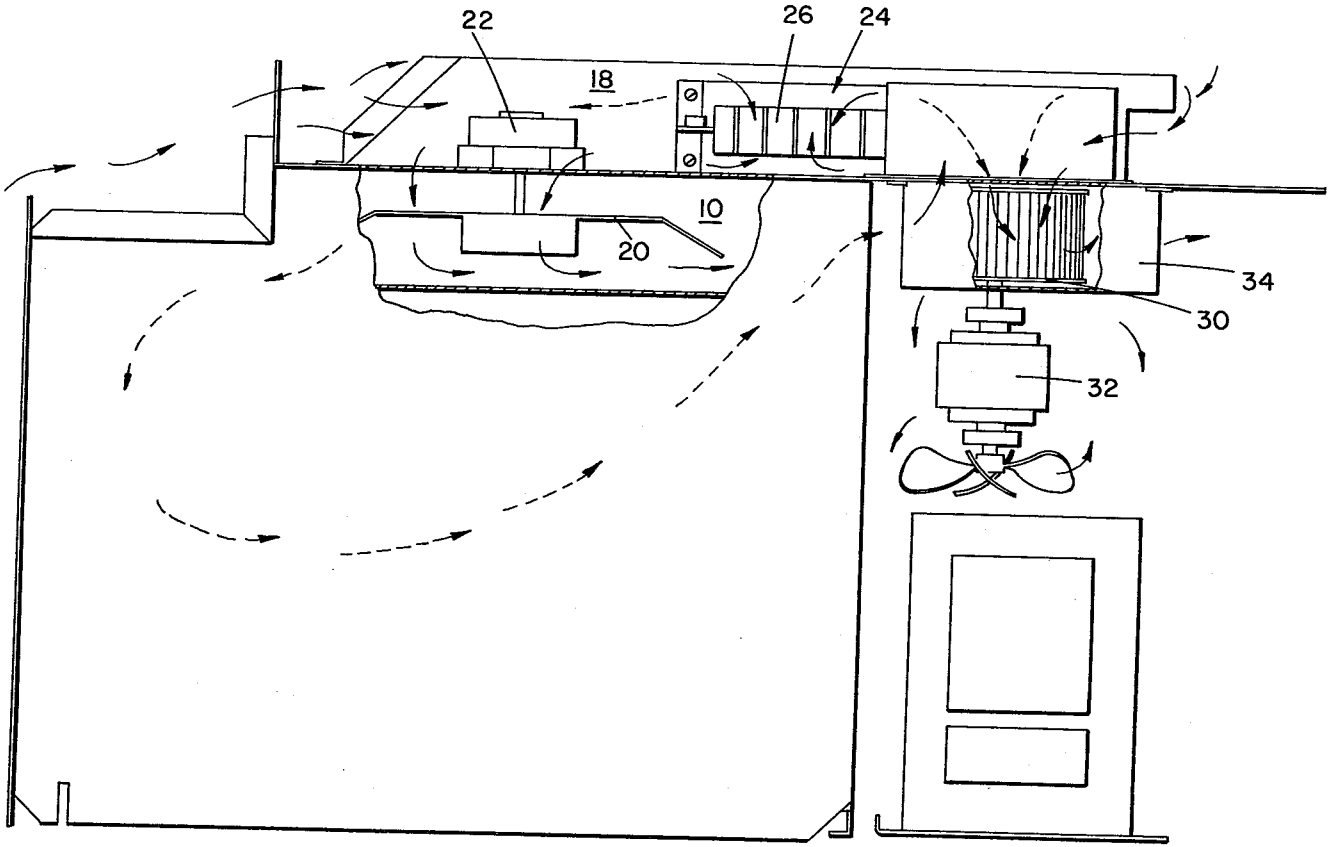
FIG. 2 illustrates a partially broken away side elevational view of the oven illustrated in FIG. 1 with the door and control panel removed.
Figure 3:
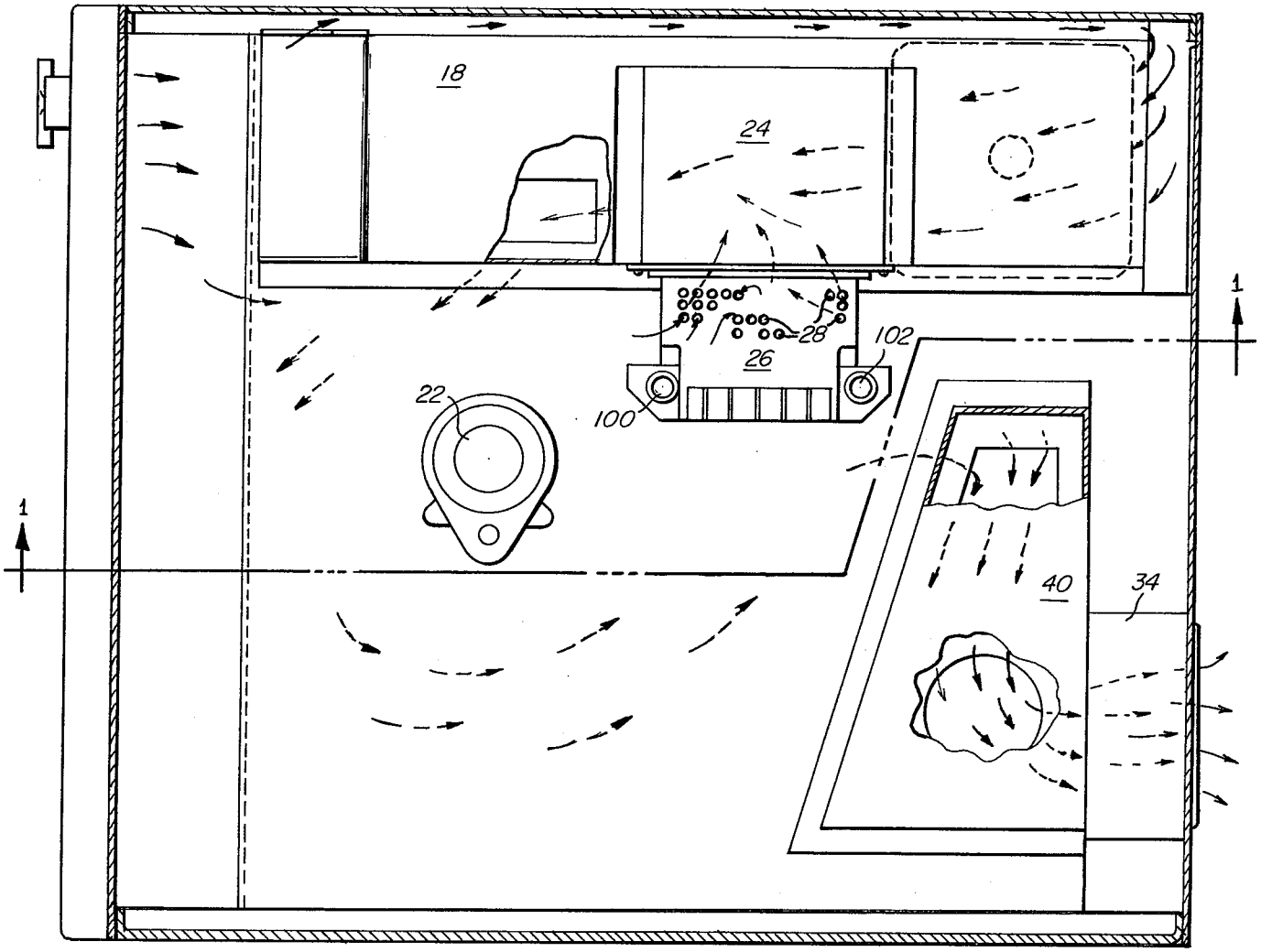
FIG. 3 illustrates a horizontal sectional view taken along line 3—3 of FIG. 1.

Referring now to FIGS. 1 through 5, there is shown a heating cavity 10 having a door 12 through which a food body 14 may be positioned in the cavity. Microwave energy is supplied to the cavity from a microwave generator such as magnetron 16 through a waveguide 18, and resonant modes in the cavity are varied by a mode stirrer 20 driven by a motor 22.

Extending into waveguide 18 between generator 16 and its point of feed into the cavity 10 is an isolator system 24 which as utilized herein, for example, consists of a circulator utilizing a ferrite in a magnetic field in waveguide 18 which permits microwave energy to pass from generator 16 into cavity 10 but causes energy reflected from cavity 10 along waveguide 18 to be directed out through the side of waveguide 18 to a microwave energy absorbing load 26 which forms part of isolator 24.

Air is drawn from outside the oven past load 26 and through the oven directly as well as being drawn through waveguide structure 18 and through the oven by a blower 30 driven by a motor 32, the output of blower 30 being directed outwardly from the oven cabinet (not shown) through a duct 34. As shown more particularly in FIG. 3, the air which moves in one end of waveguide 18 adjacent the magnetron 16 cools the output seal of the magnetron and then flows along the waveguide past the ferrite structure of isolator 24 in the waveguide cooling that structure and thence through the microwave feed aperture between the waveguide 18 and the oven 10 into the oven 10 along with air passing into the oven directly through apertures 28 adjacent load 26 after passing over load 26. For purposes of clarity, the circulation arrows are shown in solid lines where the oven is broken easily to expose the interior in which the air is circulating and the arrows are dotted where the portions of the oven are not broken and the air circulation is thence heated behind solid wall portions. After circulating in the oven, the air is drawn outwardly through a structure 40 in the top of the oven to the blower 30.

Figure 4:
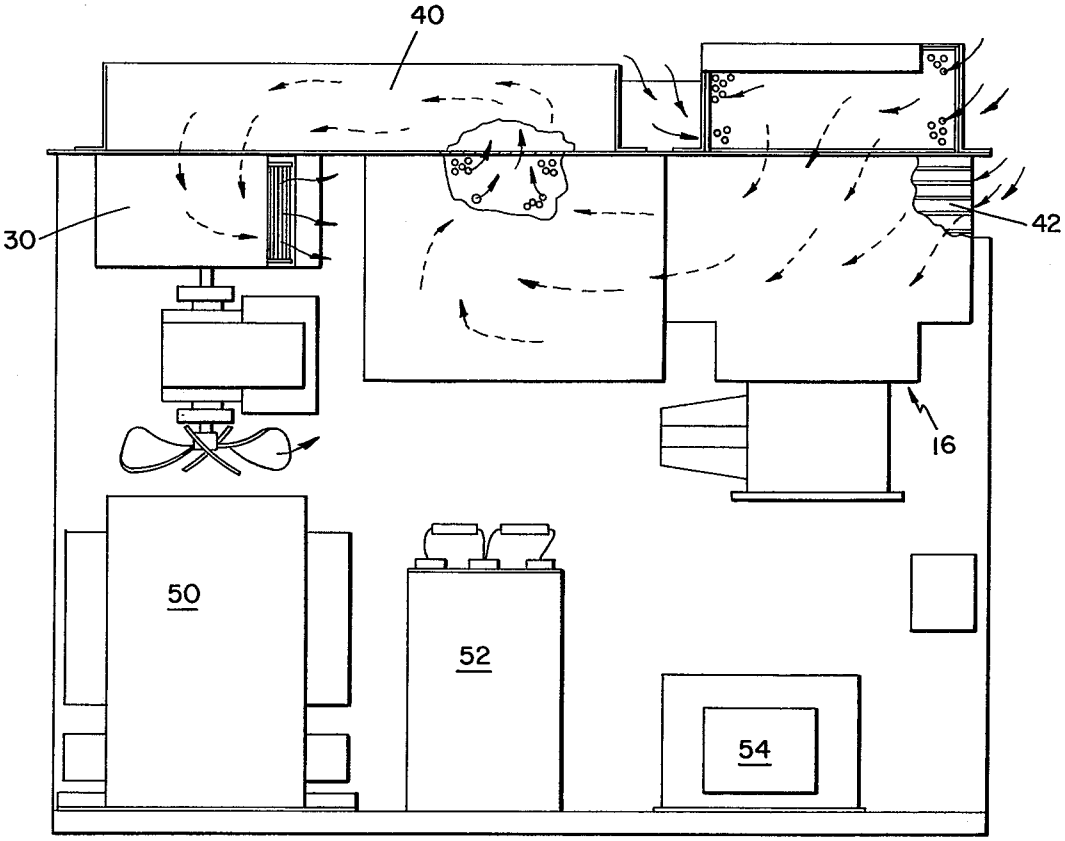
FIG. 4 illustrates a rear elevational view of the oven with the cabinet removed.

As shown more particularly in FIG. 4, air is also drawn from outside the oven through a finned anode structure 42 of magnetron 16 and, hence, through structure 40 into blower 30 so that the air through blower 30 comes from two paths, one being the air used to cool the magnetron anode and the other being the air which is used to cool the isolator system 24 and magnetron output structure and which passes through the oven to remove any gaseous cooking products from the oven thereby preventing undesirable condensation on microwave components including oven walls, waveguide or magnetron structures.

The power supply for the oven comprises a high voltage transformer 50, rectifier, condenser and resistor package 52, a filament transformer 54 for supplying power to the magnetron in accordance with well-known practice.

In accordance with this invention, power is supplied to the oven from a conventional 115-volt 60-cycle source 56, such as a plug, through an interlock and thermal protector circuit 58. One side 60 of the power line out of interlock and protector circuit 58 is connectable through a contact 62 of a relay 64 and a ten-ohm starting surge resistor 66 to one terminal of the primary winding of high voltage transformer 50, the other terminal of said winding being connected through a thermally actuated fuse 68 to the other terminal 70 of the power line output from interlock and protector circuit 58 so that upon energization of relay 64, power is supplied to transformer 50 through resistor 66.

To actuate relay 64, the door 12 is closed, closing the interlocks in the protector circuit 58 and one of the switches 72, which is ganged to one of the switches 74, and a timer circuit 76 is closed (as shown) by pushing the actuated push button with on-off switch 80 closed (as shown) in the "on" position. Filament transformer 54 is energized through a normally closed contact 82 of relay 64 and heats the filament of magnetron 16 to electron emission temperature. A light 84 on the front panel of the unit also lights, indicating the unit is ready to cook. Switch 74 causes energization of blower relay 104 directly, and relay 64 through time delay 88 after a delay of two to four seconds causes contacts 82 to shift to a second set of contacts 86 which supplies a slightly lower filament voltage to the magnetron during cooking. Time delay circuit 88 prevents actuation of relay 64 for a predetermined time after power is supplied to filament transformer 54 to allow the filament of magnetron 16 to reach electron emission temperature. A surge current relay 90 closes relay contacts 92 a few cycles of the 60-cycle rate after energization of transformer 50 due to the inertia in the relay thereby allowing the power supply condensers 52 to charge up without drawing excessive power from the plug 56. The output of delay 88 also starts timer 76 and lights cook light 85.

In accordance with this invention, a first thermally actuated switch 100 is positioned in series with the switch 80 which controls the relay 64. In the event that the reflected power from oven 10 becomes excessive, such as by positioning an improper metal container in the oven, and the temperature of microwave load 26 raises thermally actuated switch 102 on load 26 up to 160° F, switch 102, which is normally open, closes maintaining blower motor 32 as well as stirrer motor 22 continuously energized whereas normally motors 22 and 32 would be energized only during cooking by a relay 104 closing a contact 106 in response to a signal from timer 76. Thus, in the event that reflected power to the load 26 is higher than normal, the blower motor 32 will run continuously between cooking cycles drawing air past the load 26 to rapidly cool the load. In the event that thermally actuated switch 100 on load 26 reaches a temperature of 235° F, switch 100 opens de-energizing the power supply to the magnetron, the blower 30 will already be continuously operating and will rapidly cool the load 26 in a matter of a few minutes to a temperature of 150° F at which switch 100 closes and the oven 10 can be restarted. Thus, it may be seen that, by utilizing an isolator protector such as a three-port circulator with a load having two temperature sensing elements, blower power for maintaining optimum operation of the unit with a minimum down time in the event of high reflective load use by the oven can be achieved. Preferably, the switch 102 opens when the load 26 cools to around 100° F.

Additional safety circuits, such as the filter unit 107 for energizing relay 64, a latch interlock switch 105 and an overcurrent resistor 108 in the high voltage current circuit of the power supply which heats thermally actuated fuse 68 to disable the high power transformer 50 in the event excess power is drawn by the secondary winding of transformer 50, may be included (as shown).

DESCRIPTION OF THE PREFERRED MODE OF OPERATION

A body of food 14 is placed in the oven 10 and the door 12 is closed. Power is then supplied to power lines 60 and 70. Power line 60 supplies power through normally closed switch 100, thermally coupled to load 26, and through on-off switch 80 to switch section 74 while power line 70 supplies voltage to one side of blower motor 32 and stirrer motor 22 and to one side of the ready to cook light 85.

One of the switches 74, for example the top switch, is then closed by depressing the appropriate button (as shown) which also closes the top switch of group 72 since each switch of group 74 is ganged to a comparable switch of switch group 72. Closing of the switch 74 applies power to time delay 88 which has a delay of two to four seconds and through contact 82 to filament transformer 54 to heat the filament of magnetron 16. Power is also applied to relay 104 to close switch 106 energizing blower motor 32 and stirrer motor 22.

After a delay produced by time delay 88, power is supplied from the output thereof through a rectifier and filter unit 107 to energize relay 64 closing contact 86 to reduce the filament voltage and contact 62 to energize transformer 50. The application of power to transformer 50 charges condensers 52 and during this period relay 90 is closing contacts 92 so that when contacts 92 are finally closed shorting out resistor 66, condensers 52 and associated interwinding and interelectrode capacitances have been charged sufficiently to reduce the peak currents drawn through the plug 56.

The delayed power is also applied to the input of timer 76 through a rectifier 120 to produce a voltage across condenser 122 which charges condenser 124 through a resistive network 126 at a rate depending on the resistance determined by which of the switches 72 is closed. Timing circuit 76 is shown with the top button depressed selecting the maximum value of the resistive network 126 and producing a three-minute cooking time cycle. At the end of the cooking cycle, condenser 124 has charged sufficiently to fire SCR 128 through a comparator 130 to energize relay solenoid 132 opening the switches 72 and 74 to de-energize the power supply and to ring a bell 134 indicating end of the cooking cycle. The oven door may now be opened and the food body removed.

In the event that thermal sensor switch 102, which is normally open, has closed due to reflection of sufficient microwave energy into the isolator 24 to heat load 26 and switch 102 above 200° F to 220° F, switch 102 will be closed and blower motor 32 will remain running. The oven may continue to be operated for a substantial number of cycles with such a reflective load until an elevated temperature of, for example, 235° F is sensed by the sensor switch 100 whereupon switch 100 opens and power can no longer be supplied to the timer 76 via the switch 80 and the oven becomes inoperable for a few minutes until the air from the blower 30 cools the load 26 sufficiently to close thermal sensor 100, for example, at 150° F. Such operation allows the oven under normal conditions to operate sufficiently continuously, for example, in commercial establishments without overload of the oven or magnetron.

DESCRIPTION OF AN ALTERNATE EMBODIMENT

Figures 5, 6:
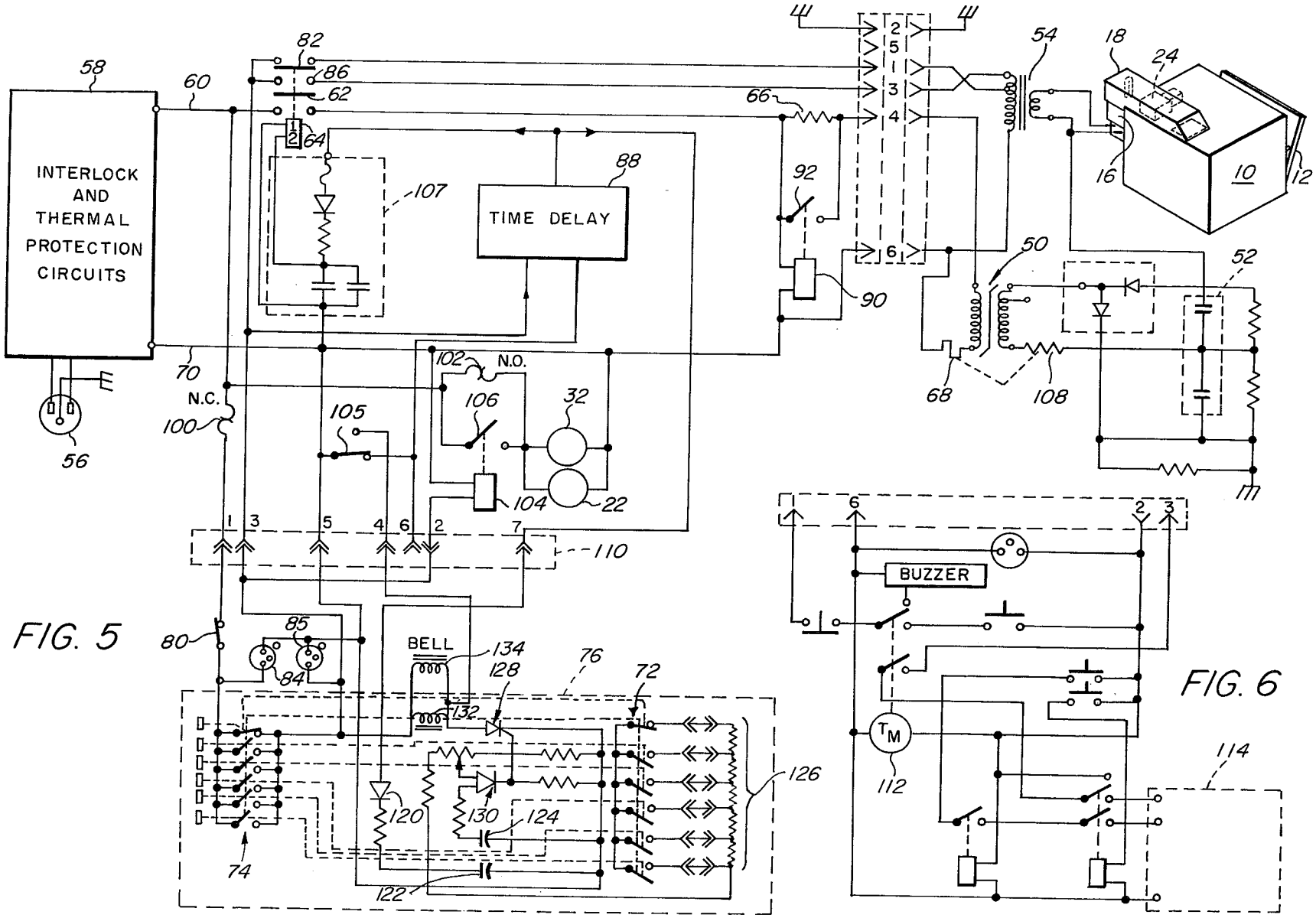
FIG. 5 illustrates a circuit diagram of a control system for the oven illustrated in FIGS. 1-4.
FIG. 6 illustrates an alternate embodiment of a timer unit which may be substituted for the timer unit of FIG. 5.

Referring now to FIGS. 5 and 6, there is shown an alternate timer system for the timer circuit 76 in which similar terminals are connected to those marked on the terminal board 110 of FIG. 5. Such a system uses a motor driven timer 112 running relays and utilizing start and stop buttons in accordance with well-known practice. In addition, an auxiliary unit 114 may be used during the timing cycle to turn the power supply intermittently on and off in a sequence of, for example, twenty seconds on/twenty seconds off so that the average power supplied by the unit is reduced to one-third normal power, for example, for defrosting foodstuffs. Under these conditions, overloading of the isolator load 26 to raise its temperature sufficiently to cause elements 100 or 102 to be thermally actuated is normally reduced. However, under certain defrosting conditions, particularly if the package contains a reflective wrapping or large quantities of ice crystals, severe reflection may be encountered approximating a condition of energization of the oven with substantially no load therein which can cause rapid heating of the load 26. Thus, it may be seen that in such a defrosting system energization of the blower 30 to cool the isolator load 26 can allow the unit to be used substantially constantly for defrosting purposes without damage to the magnetron 16 and/or de-energization of the equipment by reason of the load exceeding its upper temperature working limit.

This completes the description of the particular embodiment of the invention illustrated herein. However, many modifications thereof will be apparent to persons skilled in the art without departing from the spirit and scope of this invention. For example, any desired power supply and timing system could be used and more than one magnetron could be used to feed the same oven, each magnetron having a spearate feed and isolator system with separate blowers and controls therefor. Accordingly, it is intended that this invention be not limited by the particular details illustrated herein except as defined by the appended claims.

What is claimed is:

1. A microwave oven comprising:

a microwave energy generator for supplying microwave energy to a heating cavity;

a source of power for said microwave generator;

means coupled between the output of said microwave generator and said cavity for substantially preventing the supply of microwave energy from said cavity to said microwave generator, comprising a microwave ferite circulator and a microwave energy absorber;

a first thermal sensor responsive to a first temperature of said microwave energy absorber for maintaining a flow of a cooling fluid past said microwave energy absorber when said microwave energy generator is de-energized;

a timing control for energizing said source of power and for maintaining said flow when said microwave energy generator source of power is energized; and a second thermal sensor responsive to a second predetermined temperature of said absorber for preventing the energization of said source of power by said timing control.

2. The microwave oven in accordance with claim 1 wherein said first and second temperature sensors comprise thermally actuated switches.

3. The microwave oven in accordance with claim 2 wherein said circulator comprises a three-port circulator having said microwave energy coupled from said generator to said cavity through first and second ports of said circulator and having microwave energy reflected from said cavity toward said generator coupled through second and third ports of said circulator to said microwave energy absorber.

4. A microwave oven comprising:

a microwave energy generator for supplying microwave energy to a heating cavity;

means coupled between the output of said microwave generator and said cavity for substantially preventing the supply of microwave energy from said cavity to said microwave generator comprising a microwave ferrite circulator and a microwave energy absorber;

a first thermal sensor responsive to a first temperature of said microwave energy absorber for maintaining a flow of a cooling fluid past said microwave energy absorber when said microwave energy generator is de-energized;

a timing control for energizing said microwave energy generator and for maintaining said flow when said microwave energy generator is energized; and a second thermal sensor responsive to a second predetermined temperature of said absorber for preventing the energization of said microwave energy generator by said timing control.

5. A microwave oven comprising:

a microwave energy generator for supplying microwave energy to a heating cavity;

a waveguide coupled between the output of said microwave energy generator and said cavity;

means for substantially preventing the supply of microwave energy from said cavity to said microwave generator comprising a three port microwave ferrite circulator in said waveguide and a microwave energy absorber coupled to a port of said circulator through an apertured wall of said waveguide;

a first thermal sensor responsive to a first temperature of said microwave energy absorber for maintaining a flow of a cooling fluid past said microwave energy absorber when said microwave energy generator is de-energized;

a timing control for energizing said microwave energy generator and for maintaining said flow when said microwave energy generator is energized; and a second thermal sensor responsive to a second predetermined temperature of said absorber for preventing the energization of said microwave energy generator by said timing control.

* * * * *